US005464463A

United States Patent [19]

Miura et al.

[11] Patent Number: 5,464,463

[45] Date of Patent: Nov. 7, 1995

[54] HEAT RESISTANT ALUMINUM ALLOY POWDER HEAT RESISTANT ALUMINUM ALLOY AND HEAT AND WEAR RESISTANT ALUMINUM ALLOY-BASED COMPOSITE MATERIAL

[75] Inventors: Hirohisa Miura, Okazaki; Kunihiko Imahashi, Aichi; Hirohumi Michioka, Toyota; Yasuhiro Yamada, Tajimi; Jun Kusui, Youkaichi; Akiei Tanaka, Ohmihachiman, all of Japan

[73] Assignees: Toyota Jidosha Kabushiki Kaisha; Toyo Aluminum Kabushiki Kaisha, Japan

[21] Appl. No.: 45,697

[22] Filed: Apr. 14, 1993

[30] Foreign Application Priority Data

Apr. 16, 1992 [JP] Japan ..... 4-096520
Sep. 24, 1992 [JP] Japan ..... 4-279408

[51] Int. Cl.[6] ..... C22C 21/02

[52] U.S. Cl. ..... 75/244; 75/249; 75/252; 75/254; 75/355; 148/415; 428/545

[58] Field of Search ..... 75/252, 254, 232, 75/236, 244, 249, 355, 238, 243; 148/415; 428/545

[56] References Cited

U.S. PATENT DOCUMENTS

| | | | |
|---|---|---|---|
| 3,551,143 | 12/1970 | Manikawa | 420/528 |
| 3,885,959 | 5/1975 | Badia et al. | 148/437 |
| 4,702,885 | 10/1987 | Odani et al. | 419/23 |
| 4,722,751 | 2/1988 | Akechi et al. | 75/232 |
| 4,731,133 | 3/1988 | Dermarkar | 148/437 |
| 4,943,413 | 7/1990 | Tank | 420/528 |
| 4,946,500 | 8/1990 | Zedalis et al. | 75/232 |
| 4,975,243 | 12/1990 | Scott et al. | 420/534 |
| 5,169,718 | 12/1992 | Miura et al. | 428/408 |
| 5,279,642 | 1/1994 | Ohtera | 75/351 |
| 5,374,295 | 12/1994 | Miura et al. . | |

FOREIGN PATENT DOCUMENTS

| | | |
|---|---|---|
| 0100470 | 2/1984 | European Pat. Off. . |
| 0113249 | 7/1984 | European Pat. Off. . |
| 0147769 | 7/1985 | European Pat. Off. . |
| 0196369 | 8/1986 | European Pat. Off. . |

(List continued on next page.)

OTHER PUBLICATIONS

European Search Report.
Chemical Abstracts, vol. 113, 1990, No. 116, 15 Oct. 1990. and JP–A–1 263 244, 19 Oct. 1989.
European Search Report.
Aluminum Alloy Metallurgy Symposium.

(List continued on next page.)

*Primary Examiner*—Ngoclan Mai
*Attorney, Agent, or Firm*—Finnegan, Henderson, Farabow, Garrett & Dunner

[57] ABSTRACT

Disclosed are heat resistant aluminum alloy powder and alloy including Ni in an amount of from 5.7 to 20% by weight, Si in an amount of from 6.0 to 25% by weight, at least one of Fe in an amount of from 0.6 to 8.0% by weight and Cu in an amount of from 0.6 to 5.0% by weight, and at least one of B in a form of the simple substance in an amount of from 0.05 to 2.0% by weight (or from 0.05 to 10% by weight for the alloy) and graphite particles (especially for the alloy) in an amount of from 0.1 to 10% by weight. The alloy powder and alloy are not only superb in the tensile strength at room temperature and high temperatures but also superior in the sliding characteristic, they can be further upgraded in the wear resistance and the fretting fatigue resistance by dispersing at least one of nitride particles, boride particles, oxide particles and carbide particles in an amount of from 0.5 to 10% by weight with respect to the whole composite material including the matrix taken as 100% by weight in the matrix, thereby resulting in a heat and wear resistant aluminum alloy-based composite materials. The alloy powder, alloy and composite material are satisfactorily applicable to the component parts of the recent automobile engines which should be light-weight and produce a high output.

36 Claims, 7 Drawing Sheets

FOREIGN PATENT DOCUMENTS

| | | |
|---|---|---|
| 0196984 | 10/1986 | European Pat. Off. . |
| 0363225 | 4/1990 | European Pat. Off. . |
| 0366134 | 5/1990 | European Pat. Off. . |
| 0539172A1 | 4/1993 | European Pat. Off. . |
| 0561204A2 | 9/1993 | European Pat. Off. . |
| 3807541C1 | 7/1989 | Germany . |
| 59-13040 | 1/1984 | Japan . |
| 59-59855 | 4/1984 | Japan . |
| 60-50138 | 3/1985 | Japan . |
| 60-159137 | 8/1985 | Japan . |
| 64-83637 | 3/1989 | Japan . |
| 64-56844 | 3/1989 | Japan . |
| 1-177340 | 7/1989 | Japan . |
| 1-247546 | 10/1989 | Japan . |
| 1-272741 | 10/1989 | Japan . |
| 2-129338 | 5/1990 | Japan . |
| 2-149631 | 6/1990 | Japan . |
| 2-149633 | 6/1990 | Japan . |
| 2-149629 | 6/1990 | Japan . |
| 2-149632 | 6/1990 | Japan . |
| 2-56401 | 11/1990 | Japan . |
| 3-291348 | 12/1991 | Japan . |
| 4-105787 | 4/1992 | Japan . |
| 4-173935 | 6/1992 | Japan . |
| 4-176836 | 6/1992 | Japan . |
| 4-202737 | 7/1992 | Japan . |
| 4-202736 | 7/1992 | Japan . |
| 4-311545 | 11/1992 | Japan . |
| 4-323343 | 11/1992 | Japan . |
| 5-5147 | 1/1993 | Japan . |
| 5-5146 | 1/1993 | Japan . |
| WO90/02824 | 3/1990 | WIPO . |

OTHER PUBLICATIONS

Patent Abstracts Of Japan, vol. 13, No. 255 (C–606) Jun. 13, 1989 & JP–A–10–56 844 (Showa Denko K.K.) Mar. 3, 1989.

Patent Abstracts Of Japan, vol. 13, No. 457 (C–644) Oct. 16, 1989 & JP–A–11 77 340 (Showa Denko K.K.) Jul. 13, 1989.

HEAT RESISTANT ALUMINUM ALLOY POWDER HEAT RESISTANT ALUMINUM ALLOY AND HEAT AND WEAR RESISTANT ALUMINUM ALLOY-BASED COMPOSITE MATERIAL

BACKGROUND OF THE INVENTION

The present invention relates to materials which are usefully applicable to engine component parts, such as pistons, connecting rods, intake valves, valve lifters, valve spring retainers, cylinder liners, and so on, of automobiles, aircraft, or the like. In particular, it relates to an aluminum alloy powder, an aluminum alloy and an aluminum alloy-based composite material (hereinafter simply referred to as an "Al alloy-based MMC") which are not only excellent in the strength at high temperatures but also in the sliding characteristic.

DESCRIPTION OF THE RELATED ART

Aluminum alloys have been used as structural materials for aircraft or automobiles for a long time, because they are light-weight and have a good processability. The following conventional aluminum alloys have been known: In an aluminum alloy powder metallurgy symposium held by the Japan Light Metal Society on Mar. 9, 1987, an Al—Ni alloy was proposed which includes Ni in an amount of 5% by weight or more as set forth on pages 58 and 70 of the preprint. Unless otherwise specified, percentages (%) hereinafter mean % by weight. Further, an Al—Fe—Si alloy is disclosed in an article titled "Aluminum Alloy Powder Metallurgy" on pages 17 through 27 of the November 1989 issue of an "ALTOPIA" magazine. Furthermore, in Japanese Examined Patent Publication (KOKOKU) No. 2-56,401, an Al—Ni—Si alloy is disclosed which is made from a heat resistant, wear resistant and high tensile aluminum alloy powder. The aluminum alloy powder includes an Al—Ni—Si alloy powder containing Ni in an amount of from 7.7 to 15%, Si in an amount of from 15 to 25% and the Si crystals being 15 micrometers or less in the size.

The aluminum alloys have been known that they are much more likely to be seized when they are slid on aluminum alloys or steels than steels are. In order to improve the sliding characteristic, in Japanese Unexamined Patent Publication (KOKAI) No. 55-97,447, Japanese Examined Patent Publication (KOKOKU) No. 1-18,983, Japanese Unexamined Patent Publication (KOKAI) No. 1-132,736 and Japanese Unexamined Patent Publication (KOKAI) No. 1-246,341, there are proposed sintered aluminum alloys which are made by sintering the mixtures of aluminum alloy powders and graphite particles. Further, in Japanese Unexamined Patent Publication (KOKAI) No. 54-88,819, there is proposed a cast aluminum alloy in which boron (B) is included in an amount of from 0.4 to 5.5%. Furthermore, in Japanese Unexamined Patent Publication (KOKAI) No. 63-247,334, there is proposed a cast aluminum alloy in which B is included in an amount of from 0.5 to 10%. Moreover, a cast aluminum alloy has been known in which B is included in an amount of about 0.05% together with Ti and whose metallographic structure is made finer.

Recently, the automobile engines have been required to be light-weight in order to satisfy the low fuel consumption requirement in automobiles, and they also have been required to output a high motive power. Accordingly, the engine component parts, e.g., the connecting rods, or the like, are required to exhibit a tensile strength of 500 MPa or more at room temperature and a tensile strength of 250 MPa or more at 200° C., and they are further required to be free from seizure and to be less likely to cause the fretting fatigue when they are slid on the steel parts.

The seizure herein means one of the sliding characteristics of mechanical sliding parts. It is a phenomenon that parts of a mechanical sliding part are adhered to the mating part, the friction coefficient between them is increased suddenly and eventually they are adhered fixedly when they are slid repeatedly under a high load.

The fretting fatigue herein also means one of the sliding characteristics of mechanical sliding parts. It is a phenomenon that parts of a mechanical sliding part are adhered to the mating part and thereby they undergo the fatigue failure starting at the adhered portions when they are slid repeatedly under a high load and even under an oil lubrication.

In view of these circumstances, the Al—Ni alloy proposed in the symposium, the Al—Fe—Si alloy disclosed in the magazine and the Al—Ni—Si alloy disclosed in the patent publication are insufficient in the strength at high temperatures, and accordingly they cannot be used to produce products exhibiting the strength at high temperatures stably. Further, they exhibit a seizure-resistance load of from 4 to 8 MPa when these aluminum alloys are slid on a steel-made mating part under no lubrication. Furthermore, when they are made into a connecting rod, the connecting rods suffer from the fretting fatigue at $10^6$ times of the repetitive operations.

Moreover, the sintered aluminum alloys disclosed in aforementioned Japanese Unexamined Patent Publication (KOKAI) No. 55-97,447, and so on, exhibit a sharply deteriorated strength because of the graphite particles addition. For instance, the resulting aluminum alloys exhibit a tensile strength of from 83 to 450 MPa at most at room temperature.

In addition, the cast aluminum alloys disclosed in aforementioned Japanese Unexamined Patent Publication (KOKAI) No. 54-88,819, and the like, exhibit an insufficient sliding characteristic because B cannot be believed to exist in a form of the simple substance therein. That is, B is solved into the Al matrix in a lesser content by casting process. Indeed, B is hardly solved thereinto at room temperature, and B which has been finally solved into a molten alloy is transformed into the boride compounds such as $AlB_{12}$, or the like. As a result, the cast aluminum alloys are believed to exhibit the insufficient sliding characteristic.

Thus, the conventional aluminum alloys cannot be applied to produce the component parts of the recent automobiles, or the like.

SUMMARY OF THE INVENTION

The present invention has been developed in view of the circumstances of the conventional aluminum alloys. It is therefore an object of the present invention to provide a heat resistant aluminum alloy powder, a heat resistant aluminum alloy and a heat and wear resistant Al alloy-based MMC which can be processed into products exhibiting a superior strength at high temperatures stably as well as a superb sliding characteristic.

The present inventors investigated aluminum alloys including Ni and Si in high contents, and they found that the aluminum alloys can be remarkably improved in the heat resistance by adding at least one of Fe and Cu thereto. They continued to investigate such aluminum alloys. As a result, they come to predict that the heat resistant aluminum alloy powders including Si in high contents, Ni, and at least one of Fe and Cu can be mixed with graphite particles exhibiting a good sliding characteristic, and that the mixture can be extruded into heat resistant aluminum alloys which are superior not only in the strength but also in the sliding characteristic. They also come to forecast that the heat resistant aluminum alloys can be made into aluminum alloy powders including B in an amount of more than the solubility limit by setting the solving temperature higher so as to solve B in a larger content and thereafter by rapidly quenching in rapid quenching and solidifying process or atomizing process. The present inventors thus completed a heat resistant aluminum alloy powder and a heat resistant aluminum alloy according to the present invention.

In addition, they carried out an extensive research and development on the present aluminum alloy powder and the present aluminum alloy, and they found that the present aluminum alloy powder and the present aluminum alloy are optimum as a matrix for heat and wear resistant Al alloy-based MMCs, and that the wear resistance and the fretting fatigue resistance can be improved remarkably by dispersing at least one of nitride particles, boride particles, oxide particles and carbide particles therein. The present inventors thus completed a heat and wear resistant Al alloy-based MMC according to the present invention.

A heat resistant aluminum alloy powder according to the present invention consists essentially of Ni in an amount of from 5.7 to 20% by weight, Si in an amount of from 6.0 to 25% by weight, at least one of Fe in an amount of from 0.6 to 8.0% by weight and Cu in an amount of from 0.5 to 5.0% by weight, B in an amount of from 0.05 to 5.0% by weight, part of B being in a form of the simple substance in an amount of from 0.05 to 2.0% by weight, and the balance of Al, and the heat resistant aluminum alloy powder formed by atomizing process. When the present heat resistant aluminum alloy includes B in a form of the simple substance in the amount, the resulting present aluminum alloy is little affected in the sliding characteristic even if the rest of B is turned into boride such as $AlB_2$, $AlB_{12}$, or the like.

A heat resistant aluminum alloy according to the present invention consists essentially of Ni in an amount of from 5.7 to 20% by weight, Si in an amount of from 6.0 to 25% by weight, at least one of Fe in an amount of from 0.6 to 8.0% by weight and Cu in an amount of from 0.6 to 5.0% by weight, at least one of B in a form of the simple substance in an amount of from 0.05 to 10% by weight and graphite particles in an amount of from 0.1 to 10% by weight, and the balance of Al, and thereby the aluminum alloy exhibiting a tensile strength of 500 MPa or more at room temperature and a tensile strength of 250 MPa or more at 200° C.

A heat and wear resistant Al alloy-based MMC according to the present invention comprises a matrix, and at least one of nitride particles, boride particles, oxide particles and carbide particles dispersed, with respect to the whole composite material including the matrix taken as 100% by weight, in the matrix in an amount of from 0.5 to 10% by weight, the matrix consisting, with respect to the matrix taken as 100% by weight, essentially of, Ni in an amount of from to 20% by weight, Si in an amount of from 6.0 to 25% by weight, at least one of Fe in an amount of from 0.6 to 8.0% by weight and Cu in an amount of from 0.6 to 5.0% by weight, at least one of B in a form of the simple substance in an amount of from 0.05 to 10% by weight and graphite particles in an amount of from 0.1 to 10% by weight, and the balance of Al, and the Al alloy-based MMC formed by powder metallurgy process.

The present heat resistant aluminum alloy powder can be produced by melting and atomizing alloy raw materials having the aforementioned predetermined compositions.

The present heat resistant aluminum alloy can be produced by mixing the present heat resistant aluminum alloy powder with at least one of B in a form of the simple substance and graphite particles, and by making the mixture into an alloy by powder metallurgy process or sintering process. For instance, the present heat resistant aluminum alloy can be produced as follows: The present heat resistant aluminum alloy powder is charged in a case together with at least one of B in a form of the simple substance and graphite particles, it is cold-formed preliminarily while being kept in the state, it is then hot-extruded, and finally it is forged into the present heat resistant aluminum alloy.

The present heat and wear resistant Al alloy-based MMC can be produced as follows: At least one of nitride particles, boride particles, oxide particles and carbide particles are mixed with the present heat resistant aluminum alloy powder or the pulverized present heat resistant aluminum alloy having the aforementioned compositions, and thereafter the mixture is processed by powder metallurgy process or sintering process. For instance, the present heat and wear resistant Al alloy-based MMC can be produced as follows: The present heat resistant aluminum alloy powder is charged in a case together with at least one of nitride particles, boride particles, oxide particles and carbide particles, it is cold-formed preliminarily while being kept in the state, it is then extruded, and finally it is forged into the present heat and wear resistant Al alloy-based MMC.

The content ranges of the elements and the compounds, constituting the present heat resistant aluminum alloy powder, the present heat resistant aluminum alloy and the present heat and wear resistant Al alloy-based MMC (hereinafter collectively referred to as the "present aluminum alloy materials"), will be hereinafter described along with the reasons for the limitations.

Ni: Ni is included in the present aluminum alloy materials in an amount of from 5.7 to 20%, preferably in an amount of from 10 to 20%, with respect to the matrix taken as 100%. Ni produces intermetallic compounds, such as $NiAl_3$, NiAl, $Ni_3Al$, $Ni_2Al_3$, and so on, together with Al. These intermetallic compounds are stable at high temperatures, and they contribute to the wear resistance and the high temperature strength. Particularly, the $NiAl_3$ intermetallic compound is less hard but tougher than the other intermetallic compounds, e.g., NiAl, $Ni_3Al$, $Ni_2Al_3$, and the like.

When Ni is included therein in an amount of 5.7% or more, there arises the precipitation of $NiAl_3$ intermetallic compound in the resulting present aluminum alloy materials. However, when Ni is included therein in an amount of less than 10%, the high temperature strength cannot be improved adequately for certain applications.

When Ni is included therein in an amount of 40% or less, the resulting aluminum alloy materials form the $NiAl_3$ intermetallic compound. However, the aluminum alloy materials including Ni in an amount of more than 20% are brittle, and they exhibit an extremely small elongation at room temperature. As a result, when Ni is included therein in an amount of more than 20%, the resulting aluminum alloy materials cannot be used practically because of the remarkably deteriorated machinability, in spite of the good high temperature strength and wear resistance of products made therefrom. Thus, Ni is included in an amount of from 5.7 to 20% in the present aluminum alloy materials, preferably in an amount of from 10 to 20%, with respect to the matrix taken as 100%.

Si: Si is included in an amount of from 6.0 to 25%, preferably in an amount of from 8.0 to 20%, with respect to the matrix taken as 100%.

It has been known that aluminum alloys with fine Si crystals dispersed therein, e.g., A390 alloy, are good in the high temperature strength and the wear resistance. In the case that products are made by casting aluminum alloys including Si in an amount of 11.3% or more, coarse Si primary crystals are precipitated therein. As a result, the resulting products attack their mating component part, and they also suffer from the considerably deteriorated machinability and elongation. Hence, they are not practical from the production engineering viewpoint, e.g., the cracks, or the like, during the processing, and they might be even cracked during the service as component parts.

On the other hand, in the case that aluminum alloy materials are produced by rapid quenching and solidifying powder metallurgy process, the aluminum alloy materials can be obtained in which the fine Si crystals are precipitated even when Si is included therein in an amount of up to 25%, but they lack the heat resistance and the wear resistance when Si is included therein in an amount of less than 6.0%. Further, in the case that aluminum alloy materials are produced even by rapid quenching and solidifying process, the coarse Si crystals unpreferably precipitate in the products made from the aluminum alloy materials when Si is included therein in an amount of more than 25%. Thus, Si is included therein in an amount of from 6.0 to 25%, preferably in an amount of from 8.0 to 20%, with respect to the matrix taken as 100%.

Fe: Fe is included in the present aluminum alloy materials in an amount of from 0.6 to 8.0%, preferably in an amount of from 0.6 to 6.0%, with respect to the matrix taken as 100%. Fe is usually said that it is unpreferable to include Fe in aluminum alloy materials, and that Fe should be included therein in an amount of not more than 0.5%. However, according to the results of the experiments conducted by the present inventors, it was revealed that the resulting aluminum alloy materials can be improved in the strengths at room temperature and at the high temperature when Fe is included therein.

When Fe is included therein in an amount of less than 0.6%, the resulting aluminum alloy materials are improved less effectively in the strengths at room temperature and at the high temperature. When Fe is included therein in an amount of more than 8.0%, the resulting aluminum alloy materials are brittle. In addition, the resulting aluminum alloy materials can be effectively improved in the room temperature strength by including at least one of Fe and Cu described below, and the sum of Fe and Cu preferably falls in a range of 10% or less, further preferably in a range of from 2.0 to 10%.

Cu: Cu is included in the present aluminum alloy materials in an amount of from 0.6 to 5.0%, preferably in an amount of from 1.0 to 4.0%, with respect to the matrix taken as 100%. Cu age-hardens aluminum alloy material, thereby reinforcing the matrix.

When Cu is included therein in an amount of 0.6% or more, the resulting aluminum alloy materials are improved in the strength at room temperature effectively. When Cu is included therein in an amount of more than 5.0%, the resulting aluminum alloy materials are degraded in the high temperature strength at 300° C. because coarse precipitates arise therein. Thus, Cu is included therein in an amount of from 0.6 to 5.0%, preferably in an amount of from 1.0 to 4.0%, with respect to the matrix taken as 100%. In addition, the resulting aluminum alloy materials can be effectively improved in the room temperature strength by including at least one of Fe described above and Cu, and the sum of Fe and Cu preferably falls in a range of 10% or less, further preferably in a range of from 2.0 to 10%.

B: B is included in a form of the simple substance in an amount of from 0.05 to 2%, preferably in an amount of from 0.1 to 1.0%, with respect to the present heat resistant aluminum alloy powder taken as 100%, and it is included in a form of the simple substance in an amount of from 0.05 to 10%, preferably in an amount of from 0.1 to 5.0%, with respect to the present heat resistant aluminum alloy or the matrix of the present heat and wear resistant Al alloy-based MMC taken as 100%.

As B is included more in a form of the simple substance in aluminum alloy materials, the resulting aluminum alloy materials tend to be improved in the sliding characteristic. When B is included in an amount of less than 0.05% in aluminum alloy materials, the resulting aluminum alloy materials are improved less effectively in the sliding characteristic.

In rapid quenching and solidifying process, aluminum alloy powders including B in an amount of more than the solubility limit can be produced by setting the solving temperature higher so as to solve B in a larger content and thereafter by rapidly quenching. However, when the other elements, such as Zr, or the like, are included in molten aluminum alloys simultaneously, B is likely to transform into the boride compounds even if the aluminum alloy powders are produced by rapid quenching and solidifying process.

In particular, B can be solved into molten aluminum alloys in an amount of 0.22%, 1.7%, and 2.0%, respectively, at 730° C., 1,100° C. and 1,300° C. Accordingly, when the present heat resistant aluminum alloy powder is produced by rapid quenching and solidifying process, it is necessary to prepare molten aluminum alloys whose temperature is raised to 1,100° C. or more. As a result, in actual applications, B is included in the present aluminum alloy powder in a form of the simple substance in an amount of 2.0% or less. As far as B is included in the present aluminum alloy powder in a form of the simple substance in an amount of from 0.05 to 2.0%, the total content of B in a form of the simple substance and B in a form of boride like $AlB_2$, $AlB_{12}$, etc., can be more than 2.0% therein because the resulting present aluminum alloy is scarcely affected in the sliding characteristic by the existence of the boride. The thusly obtained present aluminum alloy powder is processed into the present heat resistant aluminum alloy or the present heat and wear resistant Al alloy-based MMC by powder metallurgy process or sintering process.

In addition, when the present heat resistant aluminum alloy or the present heat and wear resistant Al alloy-based MMC is produced by first preparing the present heat resistant aluminum alloy powder, thereafter by mixing it with boron particles and finally by extruding the mixture, it is possible to include B in a larger content because there is no limitation on the solving temperature. However, When B is included therein in an amount of more than 10%, the resulting aluminum alloys and the resulting Al alloy-based MMCs are degraded in the strength and the toughness. Thus, B is included therein in an amount of 10% or less.

Graphite particles: Graphite particles are included in an amount of from 0.1 to 10%, preferably in an amount of from 0.1 to 5.0%, with respect to the present heat resistant aluminum alloy or the matrix of the present heat and wear resistant Al alloy-based MMC taken as 100%.

As the graphite particles are included more in aluminum alloys or Al alloy-based MMCs, the resulting aluminum alloys and the resulting Al alloy-based MMCs tend to be improved in the sliding characteristic. However, as the graphite particles are included more therein, the resulting aluminum alloys and the resulting Al alloy-based MMCs are degraded in the strength. When the graphite particles are included therein in an amount of less than 0.1%, the resulting aluminum alloys and the resulting Al alloy-based MMCs are improved less effectively in the sliding characteristic. When the graphite particles are included therein in an amount of more than 10%, the resulting aluminum alloys and the resulting Al alloy-based MMCs come to be deteriorated in the strength. Thus, the graphite particles are included therein in an amount of from 0.1 to 10%, preferably in an amount of from 0.1 to 5.0%, with respect to the present heat resistant aluminum alloy or the matrix of the present heat and wear resistant Al alloy-based MMC taken as 100%.

At least one of nitride particles, boride particles, oxide particles and carbide particles: These nitride particles, boride particles, oxide particles and carbide particles improve the wear resistance and the fretting fatigue resistance. When at least one of these particles are included in Al alloy-based MMC in an amount of less than 0.5% in total, the resulting Al alloy-based MMCs are improved less effectively in the wear resistance and the fretting fatigue resistance. When at least one of these particles are included in Al alloy-based MMC in an amount of more than 10% in total, the resulting Al alloy-based MMCs are degraded considerably in the mechanical characteristics, e.g., the tensile strength, the elongation, and the like. Thus, at least one of these particles are included therein in an amount of from 0.5 to 10%, preferably in an amount of from 1.0 to 6.0%, with respect to the whole present heat and wear resistant Al alloy-based MMC including the matrix taken as 100%.

The nitride particles can be AlN, TiN, ZrN, BN particles, or the like. The boride particles can be $TiB_2$, NiB, $MgB_2$ particles, or the like. The oxide particles can be $Al_2O_3$, $SiO_2$ particles, or the like. The carbide particles can be SiC, TiC particles, or the like.

As having been described so far, since the present aluminum alloy materials include Ni, Si, Fe, Cu and at least one of B in a form of the simple substance and the graphite particles in the aforementioned predetermined amounts, not only they are light-weight, but also they exhibit the superb high temperature strength and the superior sliding characteristic stably. In particular, since the present Al alloy-based MMC includes at least one of the nitride particles, the boride particles, the oxide particles and the carbide particles, it is especially improved in the wear resistance and the fretting fatigue resistance.

All in all, when the present aluminum alloy materials are used to make the engine component parts of automobiles, or the like, they can make the engine component parts which securely satisfy the light-weight requirement and the high output requirement in the recent automobile engines.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
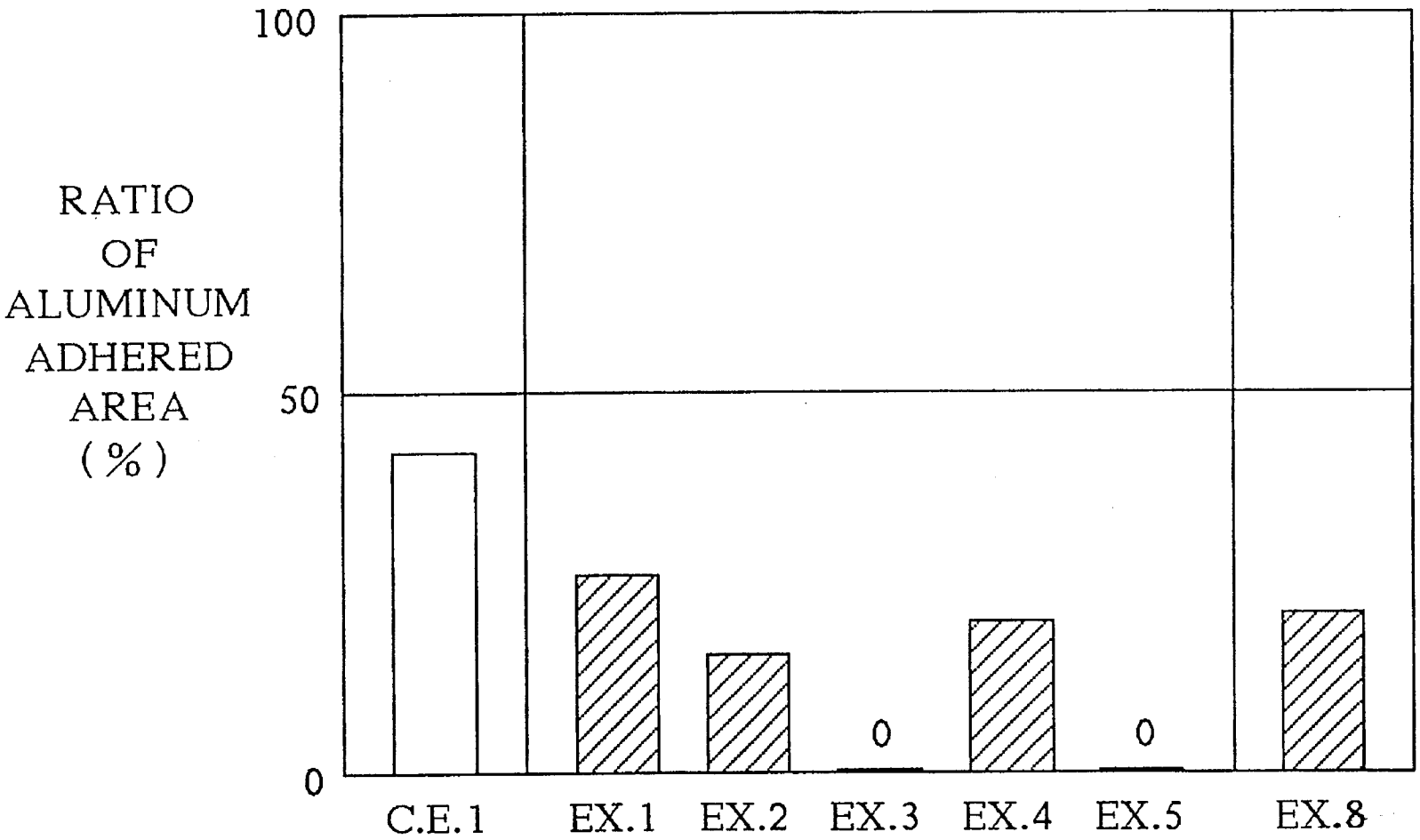
FIG. 1 is a column chart which illustrates the results of a fretting fatigue resistance test to which First and Second Preferred Embodiments according to the present invention as well as Comparative Example Nos. 1 and 2 were subjected in order to examine the aluminum adhered area ratios.

Having generally described the present invention, a further understanding can be obtained by reference to the specific preferred embodiments which are provided herein for purposes of illustration only and are not intended to limit the scope of the appended claims.

FIRST PREFERRED EMBODIMENTS

First Preferred Embodiments of the present invention, e.g., Example Nos. 1 through 3, will be hereinafter described with reference to Table 1 below and FIGS. 1 and 2, along with Comparative Example No. 1. Example Nos. 1 through 3 were subjected to a mechanical characteristics test, a fretting fatigue resistance test and a wear test together with Comparative Example No. 1 whether they stably exhibited superb strengths at high temperatures, and whether they had superior sliding characteristics.

Molten metals having compositions set forth in Table 1 were pulverized by atomizing process, and the resulting powders were classified with a minus 100 mesh sieve, respectively. Heat resistant aluminum alloy powders of Example Nos. 1 through 3 and Comparative Example No. 1 were thus prepared. Here, please note that compositions of Example Nos. 1 through 3 were based on that of Comparative Example No. 1, namely, they had the composition of Comparative Example No. 1 with boron added in a predetermined amount.

The resulting heat resistant aluminum alloy powders were charged in a tube which was bottomed with pure aluminum, and they are cold-formed preliminarily into a preform having a diameter of 30 mm and a length of 80 mm, respectively, with a pressure of 3 ton/cm$^2$ in vacuum. The preforms were heated at 450° C. for 30 minutes, and they were hot-extruded at a relatively large extrusion ratio of 10 to a plurality of rod-shaped aluminum alloy test specimens of Example Nos. 1 through 3 and Comparative Example No. 1 for the tensile strength test. The rod-shaped test specimen had a diameter of 3.5 mm and a length of 25 mm.

TABLE 1

| | COMPOSITION (%) | R.T. T.S. | 200° C. T.S. | 200° C. δ | 300° C. T.S. | 300° C. δ |
|---|---|---|---|---|---|---|
| Ex. 1 | Al-15Si-15Ni-1Fe-3Cu-0.1B | 546 | 396 | 1.5 | 257 | 3.4 |
| Ex. 2 | Al-15Si-15Ni-1Fe-3Cu-0.5B | 537 | 391 | 1.8 | 252 | 3.5 |
| Ex. 3 | Al-15Si-15Ni-1Fe-3Cu-1.0B | 548 | 412 | 1.4 | 260 | 3.0 |
| C.E. 1 | Al-15Si-15Ni-1Fe-3Cu | 565 | 427 | 1.6 | 294 | 3.5 |

(Note)
R.T.: Room Temperature,
T.S.: Tensile Strength (MPa),
δ: Elongation (%)

In addition, the resulting heat resistant aluminum alloy powders were charged in a mold, and they were hot-pressed at 450° C. with a pressure of 3 ton/cm$^2$ in vacuum, respectively. Each of the molded bodies was machined so as to prepare a plurality of plate-shaped aluminum alloy test specimens of Example Nos. 1 through 3 and Comparative Example No. 1 for the fretting fatigue resistance test described below. The plate-shaped test specimens had a length of 10 mm, a width of 9.8 mm and a thickness of 3.1 mm.

SECOND PREFERRED EMBODIMENTS

Second Preferred Embodiments of the present invention, e.g., Example Nos. 4 through 9, will be hereinafter described with reference to Table 2 below and FIGS. 1 and 2. Example Nos. 4 through 9 were also subjected to the mechanical characteristics test, the fretting fatigue resistance test and the wear test.

Example Nos. 4 through 9 were prepared as follows: First, the heat resistant aluminum alloy powder having the composition of Comparative Example No. 1 was prepared in the same manner as set forth in the "First Preferred Embodiments" section, and the resulting heat resistant aluminum alloy powder was mixed with boron particles or graphite particles by a mixer. Thus, 6 mixed powders were prepared so as to produce the following heat resistant aluminum alloys, e.g., Example No. 4 including Comparative Example No. 1 and boron in an amount of 1.0% with respect to the resulting aluminum alloy taken as 100%, Example No. 5 including Comparative Example No. 1 and boron in an amount of 5.0% with respect thereto, Example No. 6 including Comparative Example No. 1 and boron in an amount of 10.0%, with respect thereto, Example No. 7 including Comparative Example No. 1 and graphite particles in an amount of 2.0% with respect thereto, Example No. 8 including Comparative Example No. 1 and graphite particles in an amount of 5.0% with respect thereto, and Example No. 9 including Comparative Example No. 1 and graphite particles in an amount of 2.0% with respect thereto.

The 6 mixed powders were processed into a plurality of the rod-shaped aluminum alloy test specimens of Example Nos. 4 through 9 for the tensile strength test, respectively, in the same manner as described in the "First Preferred Embodiment" section.

In addition, the 6 mixed powders were also processed into a plurality of the plate-shaped aluminum alloy test specimens of Example Nos. 4 through 9 for the fretting fatigue resistance test, respectively, in the same manner as described in the "First Preferred Embodiment" section.

Table 2 summarizes the compositions of the rod-shaped aluminum alloy test specimens and the plate-shaped aluminum alloy test specimens of Example Nos. 4 through 9 for the tensile strength test and the fretting fatigue resistance test. Please note that Example Nos. 7 and 9 had the same composition except that they included different graphite particles In the First and Second Preferred Embodiments described above, the boron particles were made by KOH JUNDO KAGAKU KENKYUSHO Co., Ltd. which were classified with a minus 325 mesh sieve and had an average particle diameter $D_{50}$ of 5 micrometers.

In Example Nos. 7 and 8 of the Second Preferred Embodiments, the graphite particles were "ACP" particles made by NIHON KOKUEN Co., Ltd. which had a shape of flake and had an average particle diameter $D_{50}$ of 10 micrometers. In Example No. 9 of the Second Preferred Embodiments, the graphite particles were "J-ACP" particles made by the same which had a shape of flake and had an average particle diameter $D_{50}$ of 3 micrometers.

TABLE 2

| | COMPOSITION (%) | R.T. T.S. | 200° C. T.S. | 200° C. δ | 300° C. T.S. | 300° C. δ |
|---|---|---|---|---|---|---|
| Ex. 4 | Al-15Si-15Ni-1Fe-3Cu-1.0B | 566 | 420 | 1.3 | 248 | 3.0 |
| Ex. 5 | Al-15Si-15Ni-1Fe-3Cu-5.0B | 523 | 402 | 1.1 | 223 | 2.8 |
| Ex. 6 | Al-15Si-15Ni-1Fe-3Cu-10.0B | 502 | 388 | 0.8 | 209 | 2.5 |
| Ex. 7 | Al-15Si-15Ni-1Fe-3Cu-2.0Gr | 553 | 411 | 1.3 | 243 | 2.8 |
| Ex. 8 | Al-15Si-15Ni-1Fe-3Cu-5.0Gr | 502 | 392 | 0.9 | 212 | 2.6 |
| Ex. 9 | Al-15Si-15Ni-1Fe-3Cu-2.0Gr | 539 | 422 | 1.2 | 237 | 2.7 |

(Note)
R.T.: Room Temperature,
T.S.: Tensile Strength (MPa),
δ: Elongation (%)

Mechanical Characteristics Test

The rod-shaped aluminum alloy test specimens of Example Nos. 1 through 3 of the First Preferred Embodiments and Example Nos. 4 through 9 of the Second Preferred Embodiments were examined for the strength characteristics, e.g., the tensile strength and the elongation, and the results of the examinations are set forth in Tables 1 and 2, respectively.

As can be appreciated from Tables 1 and 2, all of the rod-shaped aluminum alloy test specimens of Example Nos. 1 through 9 exhibited a tensile strength of more than 500 MPa and more than 250 MPa, respectively, at room temperature and 200° C. Thus, they exhibited the tensile strengths which were equivalent to those of Comparative Example No. 1 free from boron and graphite particles, and they were thus superb in the tensile strength at room temperature as well as at the high temperature.

Further, there were no appreciable differences between Example Nos. 1 through 3 of the First Preferred Embodiments and Example Nos. 4 through 9 of the Second Preferred Embodiments in view of the tensile strengths at room temperature and at 200° C.

Fretting Fatigue Resistance Test

The plate-shaped aluminum alloy test specimens of Example Nos. 1 through 3 of the First Preferred Embodiments and Example Nos. 4 through 9 of the Second Preferred Embodiments were examined for the fretting fatigue resistance. This fretting fatigue resistance test was carried out as follows: The plate-shaped aluminum alloy test specimens were hit repeatedly by a stainless steel plate with a load of 1.2 MPa in surface pressure at a speed of 5 Hz at 100° C. for 10 minutes, and they were examined for the resulting adhesions thereon in a ratio of the adhered area to the whole area (%). Here, the stainless steel plate was made of nitrided JIS (Japanese Industrial Standards) 430 stainless steel. The results of the fretting fatigue resistance test are illustrated in FIG. 1.

As can be seen from FIG. 1, the plate-shaped aluminum alloy test specimens of Example No. 8 including graphite particles in an amount of 5.0% exhibited the ratio of the adhered area to the whole area which was decreased to a half or less of the plate-shaped aluminum alloy test specimens of Comparative Example No. 1 free from graphite particles. In particular, there occurred no adhesions on the plate-shaped aluminum alloy test specimens of Example No. 3 of the First Preferred Embodiments including boron in an amount of 1.0% and on those of Example No. 5 of the Second Preferred Embodiments including boron in an amount of 5.0%. Example Nos. 3 and 5 were thus especially superior in the fretting fatigue resistance.

Moreover, the ratios of the adhered area to the whole area exhibited by the plate-shaped aluminum alloys of Example Nos. 1 through 3 of the First Preferred Embodiments tell us that there was a relationship in which the adhered area decreased linearly as the boron content increased when the present heat resistant aluminum alloys were prepared by way of atomizing process.

Wear Test

Another plate-shaped aluminum alloy test specimens were prepared with Example Nos. 1 and 3 in the same manner as described in the "First Preferred Embodiment" section and with Example Nos. 4 through 9 in the same manner as described in the "Second Preferred Embodiment" section, and they were subjected to the wear test in order to examine the wear amount. These plate-shaped aluminum alloy test specimens had a width of 10 mm and a length of 15.7 mm and a thickness of 6.35 mm. The wear amount was examined by an "LFW" testing machine. During the wear test, the plate-shaped test specimens were immersed into an oil, they were pressed against a ring-shaped mating member made of SUJ2 (as per JIS) at a load of 15 kgf at a speed of 160 rpm for 15 minutes. After the wear test, the plate-shaped test specimens were examined for the specific wear amount (in $mm^3$/kgf-mm). The results of this wear test are illustrated in FIG. 2.

Figure 2:
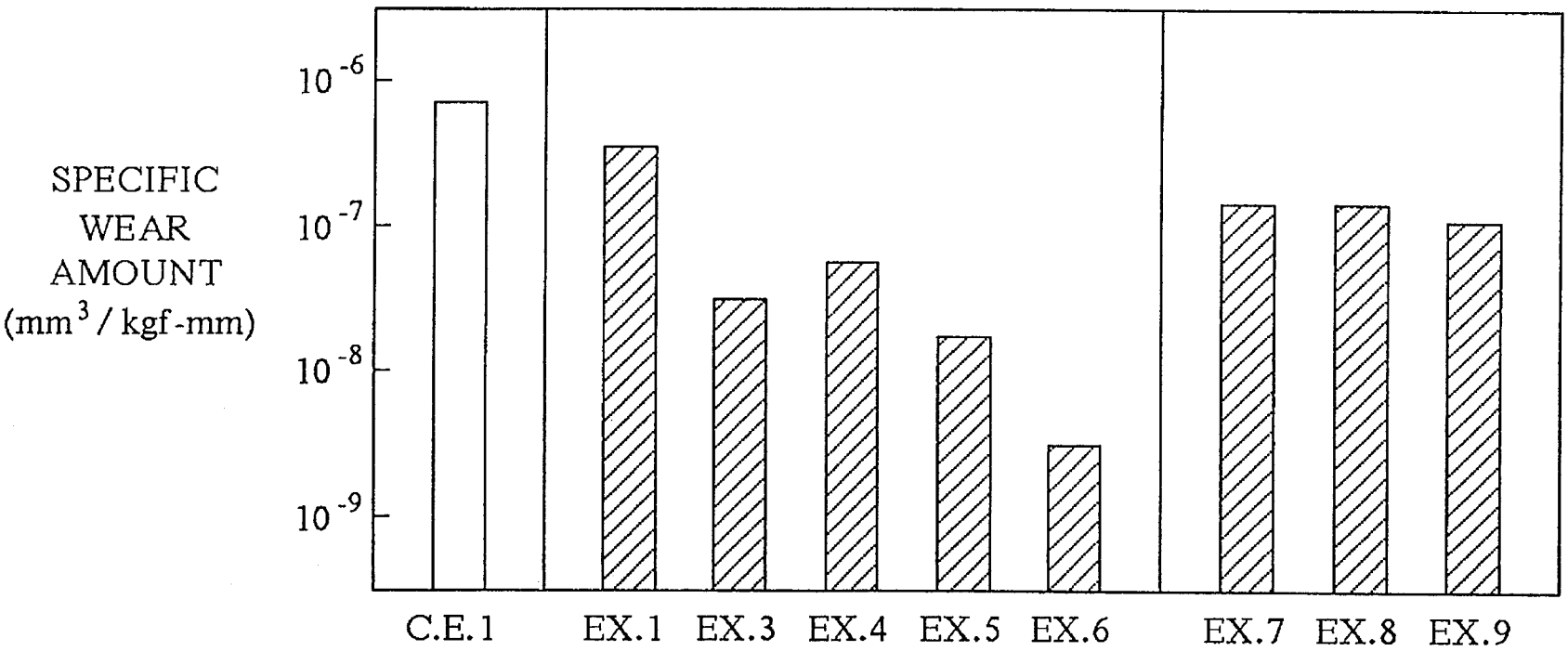
FIG. 2 is a column chart which illustrates the results of a wear test to which the First and Second Preferred Embodiments as well as Comparative Example Nos. 1 and 2 were subjected in order to examine the specific wear amounts.

As can be understood from FIG. 2, the plate-shaped aluminum alloy test specimens of Example Nos. 7, 8 and 9 including the graphite particles exhibited a specific wear amount which was reduced to about one fourth of that of the plate-shaped aluminum alloy test specimens of Comparative Example No. 1 free from the graphite particles. When the specific wear amounts exhibited by the plate-shaped aluminum alloy test specimens of Example Nos. 7, 8 and 9 are compared with each other, the difference in the amount of the graphite particles, e.g., 2.0% in Example Nos. 7 and 9, and 5.0% in Example No. 8, hardly resulted in the specific wear amount difference.

Further, when the specific wear amounts exhibited by the plate-shaped aluminum alloy test specimens of Example Nos. 1, 3, 4, 5 and 6 are compared each other, the specific wear amount decreased as the boron content increased. In particular, the specific wear amount exhibited by the plate-shaped aluminum alloy test specimens of Example No. 6 including boron particles in an amount of 10% was sharply reduced to about 1/100 or less of that exhibited by the plate-shaped aluminum alloy test specimens of Comparative Example No. 1 free from boron.

Thus, the mechanical characteristics test, the fretting fatigue resistance test and the wear test revealed that Example Nos. 1 through 3 of the First Preferred Embodiments and Example Nos. 4 through 9 of the Second Preferred Embodiments are not only light-weight but also they can be processed into products which exhibit the high temperature strength stably as well as the superb sliding characteristic.

When the boron content was equal, the plate-shaped aluminum alloy test specimens of the First Preferred Embodiments exhibited better characteristics in the fretting fatigue resistance test and the wear test than those of the Second Preferred Embodiment did. It is believed to result from the fact that the aluminum alloys prepared in accordance with the First Preferred Embodiments included boron being finer than the aluminum alloys prepared in accordance with the Second Preferred Embodiments. For example, the average particle diameter $D_{50}$ of boron was 1 micrometer or less in the aluminum alloys prepared in accordance with the First Preferred Embodiment, and it was about 5 micrometers in the aluminum alloys prepared in accordance with the Second Preferred Embodiments.

The graphite particles included crystalline carbon in the aluminum alloys of Example Nos. 7 through 9. The present inventors accordingly investigated aluminum alloys including amorphous carbon, e.g., glassy carbon, for the wear resistance. An aluminum alloy powder which included JIS 2014 aluminum alloy and Si in an amount of 15% was prepared in the same manner as described in the "First Preferred Embodiments" section, and glassy carbon was added to the aluminum alloy powder in an amount of 5.0% by weight. The resulting mixed powder was then processed into the plate-shaped aluminum alloy test specimens for the wear test in the same manner as described in the "Second Preferred Embodiments" section.

The thusly obtained plate-shaped aluminum alloy test specimens were examined for the wear resistance as set forth in the "Wear Resistance Test" section, and they exhibited a specific wear amount of $7.5\times10^{-7}$ $mm^3$/kgf-mm. Accordingly, the aluminum alloys including glassy carbon were found that they were hardly improved in the wear resistance.

THIRD PREFERRED EMBODIMENTS

The present inventors further investigated the present aluminum alloys whether they are affected by the purity, the particle diameter and the shape of the graphite particles included therein in the tensile strength, the proof stress and the elongation at room temperature strength.

First, the following 5 graphite particles were prepared: "ACP" particles made by NIHON KOKUEN Co., Ltd. which had a shape of flake and had an average particle diameter $D_{50}$ of 10 micrometers for Example No. 10, "HOP" particles made by the same which had a shape of clay and had an average particle diameter $D_{50}$ of from 2 to 3 micrometers for Example No. 11, "J-HOP" particles made by the same which had a shape of clay and had an average particle diameter $D_{50}$ of 3 micrometers for Example No. 12, "J-EP" particles made by the same which had a shape of scale and had an average particle diameter $D_{50}$ of 3 micrometers for Example No. 13, and "ACB-150" particles made by the same which had a shape of particle and had an average particle diameter $D_{50}$ of 25 micrometers for Example No. 14.

Then, an aluminum alloy powder was prepared in the same manner as described in the "First Preferred Embodiments" section. The aluminum alloy powder included Si in an amount of 8.0%, Fe in an amount of 5.0%, Ni in an amount of 3.0%, Mo in an amount of 1.05, Zr in an amount of 0.7%, Cu in an amount of 2.8%, Mg in an amount of 1.3% and the balance of Al.

Finally, the aforementioned 5 graphite particles were added to the aluminum alloy powder in an amount of 2%, respectively, and the resulting 5 mixed powders were processed into the aluminum alloys of Example Nos. 10 through 14 in the same manner as described in the "Second Preferred Embodiment" section. The aluminum alloys of Example Nos. 10 through 14 were examined for the tensile strength, the proof stress and the elongation at room temperature. The results of the examinations are summarized in Table 3 below.

It is appreciated from Table 3 that the tensile strength, the proof stress and the elongation exhibited by the aluminum alloys of Examples 10 through 14 were substantially independent of the purity, the particle diameter and the shape of the graphite particles.

Likewise, the present inventors also investigated the present aluminum alloys whether they are affected by the purity, the particle diameter and the shape of the graphite particles included therein in the fretting fatigue resistance and the wear resistance. As a result, it was verified that the difference in the purity, the particle diameter and the shape of the graphite particles hardly varied the fretting fatigue resistance and the wear resistance exhibited by the resulting present aluminum alloys substantially.

TABLE 3

| | G.P. | T.S. | P.S. | δ |
|---|---|---|---|---|
| Ex. 10 | ACP | 536* | 511 | 0.3 |
| Ex. 11 | HOP | 603 | 520 | 0.6 |
| Ex. 12 | J-HOP | 613 | 551 | 0.8 |
| Ex. 13 | J-EP | 625 | 500 | 1.0 |
| Ex. 14 | ACB-150 | 613* | 542 | 0.8 |
| C.E. 2 | None | 551 | 503 | 0.6 |

(Note)
G.P.: Graphite Particles,
T.S.: Tensile Strength (MPa)
P.S.: Proof Stress (MPa),
δ: Elongation (%)
*: Broken at Chucking.

FOURTH PREFERRED EMBODIMENT

Fourth Preferred Embodiments of the present invention, e.g., Example Nos. 15 through 20, will be hereinafter described with reference to Tables 4 and 5 below and FIGS. 3 through 10. Example Nos. 15 through 20 were the present Al alloy-based MMCs, and they were also subjected to the mechanical characteristics test, the fretting fatigue resistance test and the wear test in the same manner as described above.

Example Nos. 15 through 20 were prepared as follows: First, molten metals of heat resistant aluminum alloys whose composition is set forth in Table 4, e.g., Al—15Si—15Ni—3Cu—0.1B alloy, Al—15Si—15Ni—3Cu alloy and Al—15Si—15Ni—1Fe—1Cu—1.0B alloy, were pulverized by atomizing process and classified with a minus 100 mesh sieve, respectively, for Example Nos. 15, 16, 19 and 20, for Example No. 17 and for Example No. 18.

TABLE 4

| | COMPOSITION (%) | R.T. T.S. | 200° C. T.S. | 200° C. δ | 300° C. T.S. | 300° C. δ |
|---|---|---|---|---|---|---|
| Ex. 15 | Al-15Si-15Ni-3Cu-0.1B + 3AlN | 537 | 435 | 0.5 | 245 | 2.7 |
| Ex. 16 | Al-15Si-15Ni-3Cu-0.1B + $3TiB_2$ | 525 | 403 | 0.6 | — | — |
| Ex. 17 | Al-15Si-15Ni-3Cu-2G.P. + $3TiB_2$ | 505 | 395 | 0.5 | — | — |
| Ex. 18 | Al-15Si-15Ni-1Fe-1Cu-1.0B + 3AlN | 550 | 410 | 0.4 | — | — |
| Ex. 19 | Al-15Si-15Ni-3Cu-0.1B + 3SiC | 515 | 420 | 0.6 | — | — |
| Ex. 20 | Al-15Si-15Ni-3Cu-0.1B + $3Al_2O_3$ | 500 | 385 | 0.3 | — | — |
| C.E. 1 | Al-15Si-15Ni-1Fe-3Cu | 565 | 427 | 1.6 | 294 | 3.5 |

(Note)
G.P.: Graphite Particles,
R.T.: Room Temperature,
T.S.: Tensile Strength (MPa),
δ: Elongation (%)

Then, the thusly obtained heat resistant aluminum alloy powders were mixed with either boron particles or graphite particles by a mixer, and the resulting mixed powders were melted, pulverized by atomizing process, and classified with a minus 100 mesh sieve. Thus, matrices of Example Nos. 15 through 20 of the present heat resistant Al alloy-based MMCs were prepared in a powder form, namely the heat resistance aluminum alloy powders having the composition set forth in Table 4 but free from the additives, e.g., AlN particles, $TiB_2$ particles, SiC particles and $Al_2O_3$ particles were prepared.

The thusly obtained matrices of Example Nos. 15 through 20 were further mixed with either the graphite particles, the AlN particles, the $TiB_2$ particles, the SiC particles or the $Al_2O_3$ particles in the predetermined amount with respect to the whole composite material including the matrix taken as 100%, respectively, by a mixer, and the resulting mixed powders were processed into the rod-shaped Al alloy-based MMC test specimens of Example Nos. 15 through 20 for the mechanical characteristics test in the same manner as set forth in the "First Preferred Embodiment" section. In Table 4, please not that the numbers before the elements specify the content of the elements in % by weight with respect to the matrix taken as 100% by weight, and the numbers before the additives, e.g., nitride particles, boride particles, carbide particles and oxide particles, specify the content of the additives in % by weight with respect to the sum of the matrix and the additives, i.e., the whole Al alloy-based MMCs, taken as 100% by weight.

Further, for comparison purpose, the molten metal of the Al—15Si—15Ni—1Fe—3Cu alloy (i.e., Comparative Example No. 1) was also pulverized by atomizing process and classified with a minus 100 mesh sieve, respectively, for Reference Example Nos. 1, 2, 3, 4, 5, 7, 8 and 9. Likewise, Reference Example Nos. 1, 2, 3, 4, 5, 7, 8 and 9 were also processed into the rod-shaped aluminum alloy test specimens for the mechanical characteristics test. Please note that Reference Example Nos. 1, 2 and 3 were adapted to have the same compositions as those of Example Nos. 1, 2 and 3 of the First Preferred Embodiments, and that Reference Example Nos. 4, 5, 7, 8 and 9 were identical with Example Nos. 4, 5, 7, 8 and 9 of the Second Preferred Embodiments.

Furthermore, the mixed powders adapted for producing Example Nos. 15 through 20 of the Fourth Preferred Embodiments were processed into the plate-shaped test specimens for the fretting fatigue resistance test in the same manner as set forth in the "First Preferred Embodiments" section. Similarly, Reference Example Nos. 1, 2, 3, 4, 5, 7, 8 and 9 were also processed into the plate-shaped test specimens for the fretting fatigue resistance test.

In Example No. 17 of the Fourth Preferred Embodiments, the graphite particles were "Mesocarbon" particles (spheroidal graphite) made by OSAKA GAS Co., Ltd. which had a shape of particle and had an average particle diameter $D_{50}$ of 6 micrometers. In Reference Example Nos. 7 and 8, the graphite particles were "ACP" particles made by the same which had a shape of flake and had an average particle diameter $D_{50}$ of 10 micrometers. In Reference Example No. 9, the graphite particles were "J-ACP" particles made by the same which had a shape of flake and had an average particle diameter $D_{50}$ of 3 micrometers.

In Example Nos. 15 and 18 of the Fourth Preferred Embodiments, the AlN particles were made by TOYO ALUMINIUM Co., Ltd. which had an average particle diameter $D_{50}$ of 7.3 micrometers. In Example Nos. 16 and 17 thereof, the $TiB_2$ particles were made by IDEMITSU SEKIYU KAGAKU Co., Ltd. which had an average particle diameter $D_{50}$ of 2.3 micrometers. In Example No. 19 thereof, the SiC particles were made by IBIDEN Co., Ltd. which had an average particle diameter $D_{50}$ of 2.6 micrometers. In Example No. 20 thereof, the $Al_2O_3$ particles were made by SHOWA DENKO Co., Ltd. which had an average particle diameter $D_{50}$ of 0.5 micrometers.

TABLE 5

| | COMPOSITION (%) | R.T. T.S. | 200° C. T.S. | 200° C. δ | 300° C. T.S. | 300° C. δ |
|---|---|---|---|---|---|---|
| R.E. 1 | Al-15Si-15Ni-1Fe-3Cu-0.1B | 546 | 396 | 1.5 | 257 | 3.4 |
| R.E. 2 | Al-15Si-15Ni-1Fe-3Cu-0.5B | 537 | 391 | 1.8 | 252 | 3.5 |

TABLE 5-continued

| | COMPOSITION (%) | R.T. T.S. | 200° C. T.S. | 200° C. δ | 300° C. T.S. | 300° C. δ |
|---|---|---|---|---|---|---|
| R.E. 3 | Al-15Si-15Ni-1Fe-3Cu-1.0B | 548 | 412 | 1.4 | 260 | 3.0 |
| R.E. 4 | Al-15Si-15Ni-1Fe-3Cu-1.0B | 566 | 420 | 1.3 | 248 | 3.0 |
| R.E. 5 | Al-15Si-15Ni-1Fe-3Cu-5.0B | 523 | 402 | 1.1 | 223 | 2.8 |
| R.E. 7 | Al-15Si-15Ni-1Fe-3Cu-2.0Gr | 553 | 411 | 1.3 | 243 | 2.8 |
| R.E. 8 | Al-15Si-15Ni-1Fe-3Cu-5.0Gr | 502 | 392 | 0.9 | 212 | 2.6 |
| R.E. 9 | Al-15Si-15Ni-1Fe-3Cu-2.0Gr | 539 | 422 | 1.2 | 237 | 2.7 |

(Note)
R.T.: Room Temperature,
T.S.: Tensile Strength (MPa),
δ: Elongation (%)

Mechanical Characteristics Test

The rod-shaped Al alloy-based MMC test specimens of Example Nos. 15 through 20 of the Fourth Preferred Embodiments and the rod-shaped aluminum alloy test specimens of Reference Example Nos. 1, 2, 3, 4, 5, 7, 8 and 9 were examined for the strength characteristics, e.g., the tensile strength and the elongation, and the results of the examinations are set forth in Tables 4 and 5, respectively.

As can be appreciated from Table 4, all of the rod-shaped Al alloy-based MMC test specimens of Example Nos. 15 through 20 exhibited a tensile strength of more than 500 MPa and more than 250 MPa, respectively, at room temperature and 200° C. It is understood by comparing Table 4 with Table 5 that the rod-shaped Al alloy-based MMC test specimens of Example Nos. 15 through 20 exhibited the tensile strengths as good as those exhibited by the aluminum alloy test specimens of Reference Example Nos. 1, 2, 3, 4, 5, 7, 8 and 9. Example Nos. 15 through 20 were thus superb in the tensile strength at room temperature as well as at the high temperature.

Fretting Fatigue Resistance Test

The plate-shaped Al alloy-based MMC test specimens of Example Nos. 15 and 16 of the Fourth Preferred Embodiments and the plate-shaped aluminum alloy test specimens of Reference Example Nos. 1, 2, 3, 4, 5 and 8 were examined for the fretting fatigue resistance in the same manner as Example Nos. 1 through 3 of the First Preferred Embodiments and Example Nos. 4 through 9 of the Second Preferred Embodiments were examined therefor. The results of the fretting fatigue resistance test are illustrated in FIG. 3.

Figure 3:
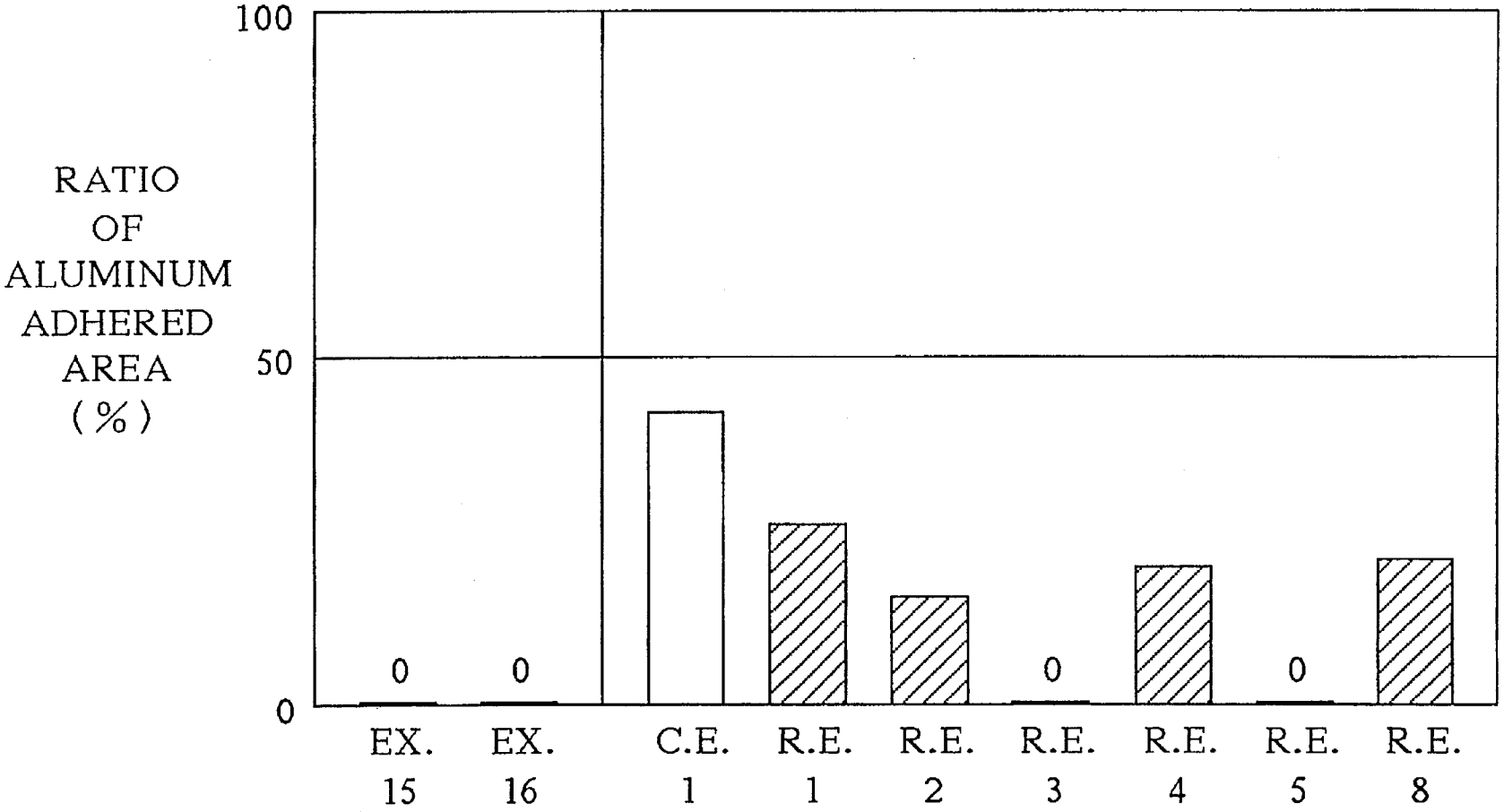
FIG. 3 is a column chart which illustrates the results of the fretting fatigue resistance test to which Fourth Preferred Embodiments according to the present invention and Comparative Example Nos. 1 and 2 were subjected in order to examine the aluminum adhered area ratios.

As can be seen from FIG. 3, there occurred less adhesions on the plate-shaped Al alloy-based MMC test specimens of Example Nos. 15 and 16 of the Fourth Preferred Embodiments. Example Nos. 15 and 16 were thus superior in the fretting fatigue resistance.

Wear Test

Another plate-shaped Al alloy-based MMC test specimens were prepared with Example Nos. 15 through 19 in the same manner as the plate-shaped Al alloy-based MMC test specimens were prepared for the above fretting fatigue resistance test in the "Fourth Preferred Embodiments" section. The plate-shaped Al alloy-based MMC test specimens had a width of 10 mm and a length of 15.7 mm and a thickness of 6.35 mm, and they were subjected to the above-described wear test, to which those of Example Nos. 1 through 9 of the First and Second Preferred Embodiments were subjected, in order to examine the wear amount. The same plate-shaped aluminum alloy test specimens were prepared with Reference Example Nos. 1, 3, 4, 5, 7, 8 and 9 as well as with Comparative Example No. 1, and they were also subjected to the wear test. The results of this wear test are illustrated in FIG. 4.

Figure 4:
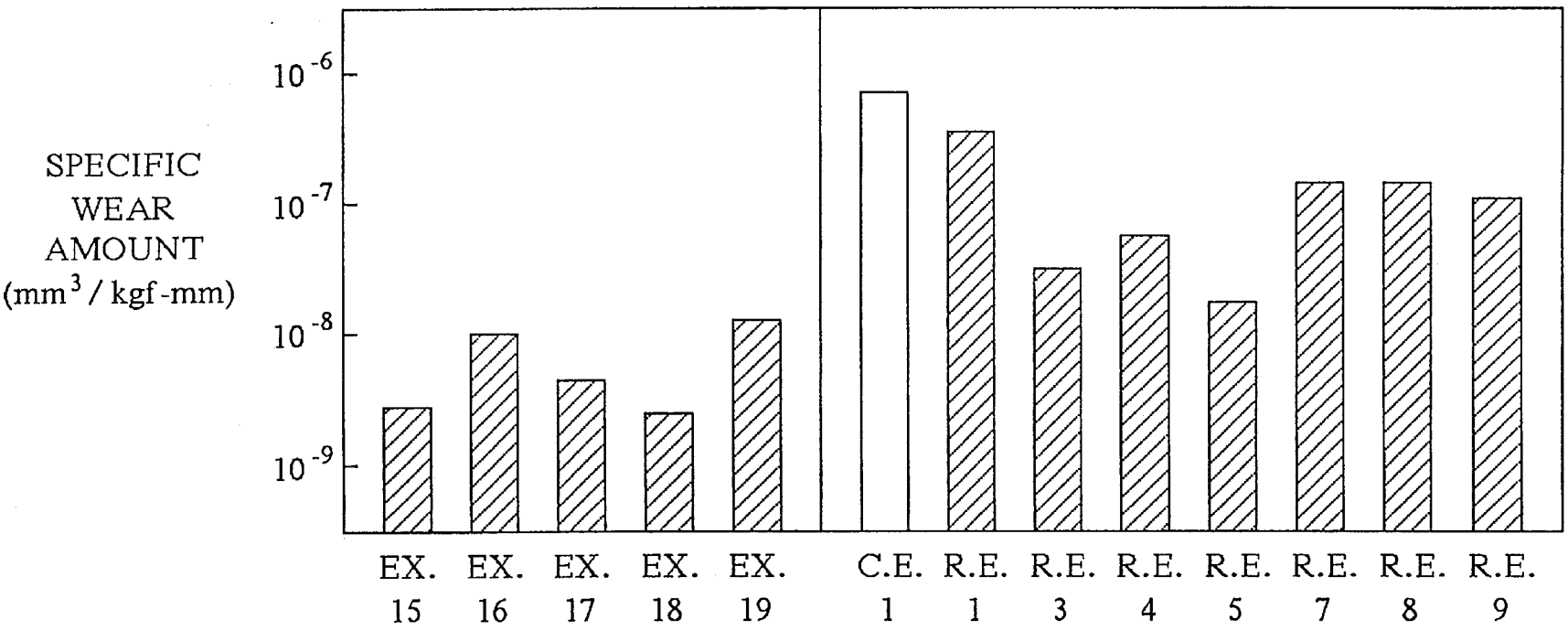
FIG. 4 is a column chart which illustrates the results of the wear test to which the Fourth Preferred Embodiments according to the present invention and Comparative Example No. 1 were subjected in order to examine the specific wear amounts.

As can be understood from FIG. 4, the plate-shaped Al alloy-based MMC test specimens of Example Nos. 15 through 19 exhibited a specific wear which was less than did the plate-shaped aluminum alloy test specimens of Reference Example Nos. 1, 3, 4, 5, 7, 8 and 9 as well as Comparative Example No. 1 Example Nos. 16 through 19 of the Fourth Preferred Embodiments were thus excellent in the wear resistance.

Thus, the mechanical characteristics test, the fretting fatigue resistance test and the wear test revealed that Example Nos. 16 through 20 of the Fourth Preferred Embodiments are not only light-weight but also they can be processed into products which exhibit the improved wear resistance and the upgraded fretting fatigue resistance in addition to the stable high temperature strength and the superb sliding characteristic.

SEM and EPMA Test

Figure 5:
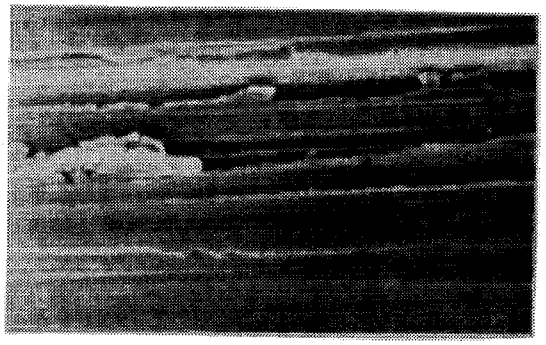
FIG. 5 is an SEM (Scanning Electron Microscope) photograph (magnification×800) on a mating member after slid against Example No. 15 of the Fourth Preferred Embodiments in the wear test.
Figure 6:
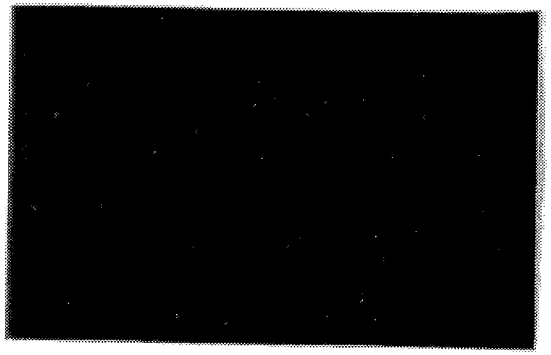
FIG. 6 is an Al scattering of EPMA (Electron Probe Microanalysis) photograph on the mating member after slid against Example No. 15 of the Fourth Preferred Embodiments in the wear test.
Figure 7:
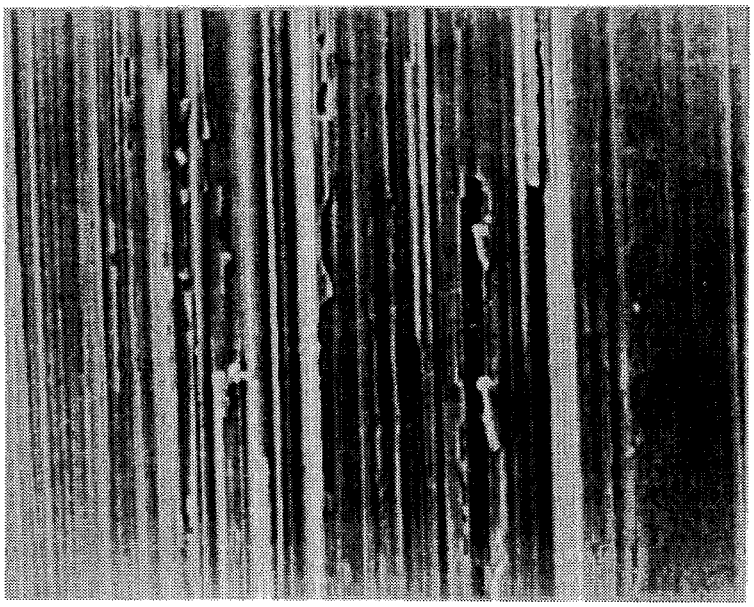
FIG. 7 is an SEM photograph (magnification×800) on a mating member after slid against Example No. 17 of the Fourth Preferred Embodiments in the wear test.
Figure 8:
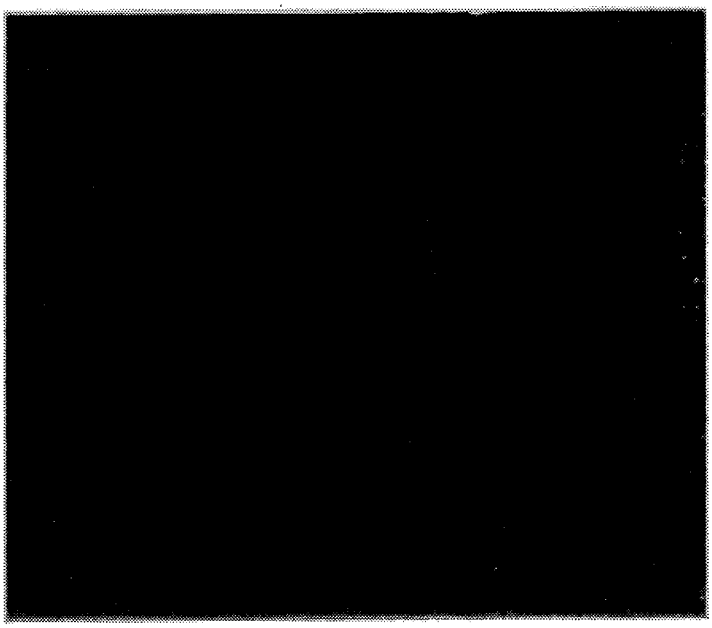
FIG. 8 is an Al scattering of EPMA photograph on the mating member after slid against Example No. 17 of the Fourth Preferred Embodiments in the wear test.
Figure 9:
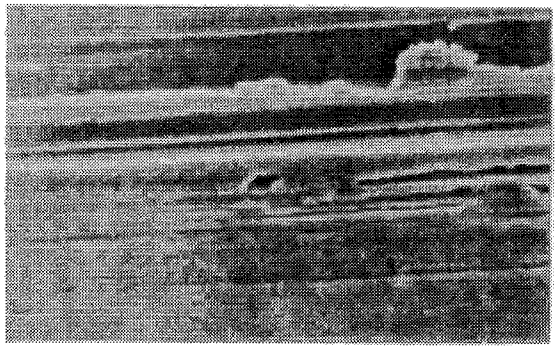
FIG. 9 is an SEM photograph (magnification ×800) on a mating member after slid against Reference Example No. 1 in the wear test.
Figure 10:
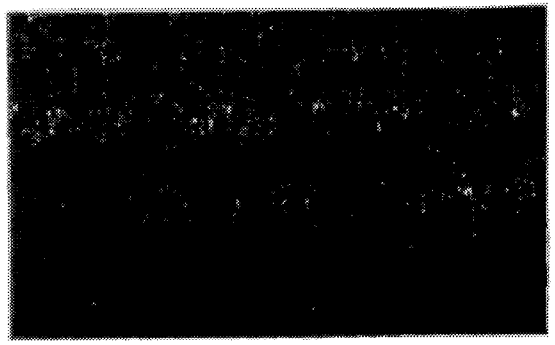
FIG. 10 is an Al scattering of EPMA photograph on the mating member after slid against Reference Example No. 1 in the wear test.

After the wear test, namely after the plate-shaped Al alloy-based MMC test specimens of Example Nos. 15 and 17 and the plate-shaped aluminum alloy test specimen of Reference Example No. 1 were slid against the mating members made of SUJ2, the surfaces of the mating members were analyzed by SEM and EPMA. FIG. 5 is an SEM photograph on the mating member after slid against Example No. 15 of the Fourth Preferred Embodiments, and FIG. 6 is an Al scattering of EPMA photograph on the mating member. FIG. 7 is an SEM photograph on the mating member after slid against Example No. 17 of the Fourth Preferred Embodiments, and FIG. 8 is an Al scattering of EPMA photograph on the mating member. FIG. 9 is an SEM photograph on the mating member after slid against Reference Example No. 1, and FIG. 10 is an Al scattering of EPMA photograph on the mating member.

As can be seen from FIGS. 5 through 10, aluminum was adhered less on the mating members on which the plate-shaped Al alloy-based MMC test specimens of Example Nos. 15 and 17 were slid. However, aluminum was adhered on the mating member on which the plate-shaped aluminum alloy specimen of Reference Example No. 1 was slid. Thus, the SEM and EPMA test also revealed that the heat resistant Al alloy-based MMC of Example Nos. 15 and 17 were upgraded in the wear resistance and the fretting fatigue resistance.

Having now fully described the present invention, it will be apparent to one of ordinary skill in the art that many changes and modifications can be made thereto without departing from the spirit or scope of the present invention as set forth herein including the appended claims.

What is claimed is:

1. A heat resistant aluminum alloy powder consisting essentially of:

Ni in an amount of from 5.7 to 20% by weight;

Si in an amount of from 6.0 to 25% by weight;

at least one of Fe in an amount of from 0.6 to 8.0% by weight and Cu in an amount of from 0.6 to 5.0% by weight;

B in the form of the simple substance in an amount of from 0.05 to 2.0% by weight; and the balance of Al;

wherein said heat resistant aluminum alloy powder is formed by an atomizing process.

2. The heat resistant aluminum alloy powder according to claim 1, wherein said Ni is present in an amount of from 10 to 20% by weight.

3. The heat resistant aluminum alloy powder according to claim 1, wherein said Si is present in an amount of from 8.0 to 20% by weight.

4. The heat resistant aluminum alloy powder according to claim 1, wherein said Fe is present in an amount of from 0.6 to 6.0% by weight.

5. The heat resistant aluminum alloy powder according to claim 1, wherein said Cu is present in an amount of from 1.0 to 4.0% by weight.

6. The heat resistant aluminum alloy powder according to claim 1 wherein the sum of said Fe and said Cu is 10% by weight or less.

7. The heat resistant aluminum alloy powder according to claim 6 wherein the sum of Fe and Cu falls in a range of from 2.0 to 10% by weight.

8. The heat resistant aluminum alloy powder according to claim 1, wherein said B is in the form of the simple substance in an amount of from 0.1 to 1.0% by weight.

9. A heat resistant aluminum alloy powder consisting essentially of:

Ni in an amount of from 5.7 to 20% by weight;

Si in an amount of from 6.0 to 25% by weight;

at least one of Fe in an amount of from 0.6 to 8.0% by weight and Cu in an amount of from 0.6 to 5.0% by weight;

B in an amount of from 0.05 to 5.0% by weight, and a part of said B being in the form of the simple substance in an amount of from 0.05 to 2.0% by weight; and the balance of Al;

wherein said heat resistant aluminum alloy powder is formed by an atomizing process.

10. A heat resistant aluminum alloy consisting essentially of:

Ni in an amount of from 5.7 to 20% by weight;

Si in an amount of from 6.0 to 25% by weight;

at least one of Fe in an amount of from 0.6 to 8.0% by weight and Cu in an amount of from 0.6 to 5.0% by weight;

B in the form of the simple substance in an amount of from 0.05 to 10% by weight; and the balance of Al;

said aluminum alloy exhibiting a tensile strength of 500 MPa or more at room temperature and a tensile strength of 250 MPa or more at 200° C.

11. The heat resistant aluminum alloy according to claim 10, wherein said Ni is present in an amount of from 10 to 20% by weight.

12. The heat resistant aluminum alloy according to claim 10, wherein said Si is present in an amount of from 8.0 to 20% by weight.

13. The heat resistant aluminum alloy according to claim 10, wherein said Fe is present in an amount of from 0.6 to 6.0% by weight.

14. The heat resistant aluminum alloy according to claim 10, wherein said Cu is present in an amount of from 1.0 to 4.0% by weight.

15. The heat resistant aluminum alloy according to claim 10 wherein the sum of said Fe and said Cu is 10% by weight or less.

16. The heat resistant aluminum alloy according to claim 15 wherein the sum of Fe and Cu falling in a range of from 2.0 to 10% by weight.

17. The heat resistant aluminum alloy according to claim 10, wherein said B is in the form of the simple substance in an amount of from 0.1 to 5.0% by weight.

18. The heat resistant aluminum alloy according to claim 10 further including graphite particles in an amount of from 0.1 to 10% by weight.

19. The heat resistant aluminum alloy according to claim 10 formed by first atomizing a molten metal having the composition recited in claim 10 and then by processing the resulting powder by a powder metallurgy process.

20. The heat resistant aluminum alloy according to claim 10 formed by first atomizing a molten metal having the composition recited in claim 10 but free from said B, mixing the resulting powder with boron particles and then processing the mixed powder by a powder metallurgy process.

21. A heat and wear resistant aluminum alloy-based composite material, comprising:

a matrix; and at least one of nitride particles, boride particles, oxide particles and carbide particles dispersed, with respect to the whole composite material including the matrix taken as 100% by weight, in the matrix in an amount of from 0.5 to 10% by weight;

the matrix consisting, with respect to the matrix taken as 100% by weight, essentially of:

Ni in an amount of from 5.7 to 20% by weight;

Si in an amount of from 6.0 to 25% by weight;

at least one of Fe in an amount of from 0.6 to 8.0% by weight and Cu in an amount of from 0.6 to 5.0% by weight;

B in a form of the simple substance in an amount of from 0.05 to 10% by weight; and, the balance of Al;

wherein said aluminum alloy-based composite material is formed by a powder metallurgy process.

22. The heat and wear resistant aluminum alloy-based composite material according to claim 21, wherein, with respect to said matrix taken as 100% by weight, said Ni is present in an amount of from 10 to 20% by weight.

23. The heat and wear resistant aluminum alloy-based composite material according to claim 21, wherein, with respect to said matrix taken as 100% by weight, said Si is present in an amount of from 8.0 to 20% by weight.

24. The heat and wear resistant aluminum alloy-based composite material according to claim 21, wherein, with respect to said matrix taken as 100% by weight, said Fe is present in an amount of from 0.6 to 6.0% by weight.

25. The heat and wear resistant aluminum alloy-based composite material according to claim 21, wherein, with respect to said matrix taken as 100% by weight, said Cu is present in an amount of from 1.0 to 4.0% by weight.

26. The heat and wear resistant aluminum alloy-based composite material according to claim 21 wherein the sum of said Fe and said Cu is 10% by weight or less with respect to said matrix taken as 100% by weight.

27. The heat and wear resistant aluminum alloy-based composite material according to claim 26 wherein the sum of said Fe and said Cu falls in a range of from 2.0 to 10% by weight with respect to said matrix taken as 100% by weight.

28. The heat and wear resistant aluminum alloy-based composite material according to claim 21, wherein, with respect to said matrix taken as 100% by weight, said B is in the form of the simple substance in an amount of from 0.1 to 5.0% by weight.

29. The heat and wear resistant aluminum alloy-based composite material according to claim 21 further including, with respect to said matrix taken as 100% by weight, graphite particles in an amount of from 0.1 to 10% by weight.

30. The heat and wear resistant aluminum alloy-based composite material according to claim 21, wherein said matrix is formed by first atomizing a molten metal having the composition recited in claim 21 and then processing the resulting powder by a powder metallurgy process.

31. The heat and wear resistant aluminum alloy-based composite material according to claim 21, wherein said matrix is formed by first atomizing a molten metal having the composition recited in claim 21 but free from said B, mixing the resulting powder with boron particles and then processing the mixed powder by a powder metallurgy process.

32. The heat and wear resistant aluminum alloy-based composite material according to claim 21 including at least one of said nitride particles, said boride particles, oxide particles and said carbide particles dispersed, with respect to the whole composite material including said matrix taken as 100%, in said matrix in an amount of from 1.0 to 6.0% by weight.

33. The heat and wear resistant aluminum alloy-based composite material according to claim 21 wherein said nitride particles are at least one selected from the group consisting of AlM, TiN, ZrN and BN particles.

34. The heat and wear resistant aluminum alloy-based composite material according to claim 21 wherein said boride particles are at least one selected from the group consisting of $TiB_2$, NiB and $MgB_2$ particles.

35. The heat and wear resistant aluminum alloy-based composite material according to claim 21 wherein said oxide particles are at least one selected the group consisting of $Al_2O_3$ and $SiO_2$ particles.

36. The heat and wear resistant aluminum alloy-based composite material according to claim 21 wherein said carbide particles are SiC and TiC particles.

* * * * *

UNITED STATES PATENT AND TRADEMARK OFFICE

CERTIFICATE OF CORRECTION

PATENT NO. : 5,464,463

DATED : November 7, 1995

INVENTOR(S) : Hirohisa MIURA et al.

It is certified that error appears in the above-indentified patent and that said Letters Patent is hereby corrected as shown below:

Title page, column 1, under "Assignees", line 3, insert --both of-- before "Japan".

In the title, line 2, insert --,-- after "POWDER".

Claim 16, column 19, line 2, "falling" should read --falls--.

Claim 21, column 19, line 32, after "weight", insert --;--;
line 36, after "and", delete ",".

Claim 33, column 20, line 42, "AIM" should read --AlN--.

Signed and Sealed this

Twenty-sixth Day of March, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,464,463
DATED : November 7, 1995
INVENTOR(S) : Hirohisa Miura et al.

It is certified that error appears in the above-indentified patent and that said Letters Patent is hereby corrected as shown below: On the title page: Item [73]

second Assignee, should be changed from "Toyo Aluminum Kabushiki Kaisha" to --Toyo Aluminium Kabushiki Kaisha--.

Signed and Sealed this
Twentieth Day of August, 1996

Bruce Lehman

*Attest:*

BRUCE LEHMAN

*Attesting Officer*

*Commissioner of Patents and Trademarks*